US011038248B2

(12) United States Patent
Harel

(10) Patent No.: US 11,038,248 B2
(45) Date of Patent: Jun. 15, 2021

(54) APPARATUS FORMING A STRIP LINE AND DIELECTRIC PART

(71) Applicant: NOKIA SHANGHAI BELL CO., LTD., Shanghai (CN)

(72) Inventor: Jean-Pierre Harel, Lannion (FR)

(73) Assignee: NOKIA SHANGHAI BELL CO., LTD., Shanghai (CN)

( * ) Notice: Subject to any disclaimer, the term of this patent is extended or adjusted under 35 U.S.C. 154(b) by 106 days.

(21) Appl. No.: 16/306,632

(22) PCT Filed: May 15, 2017

(86) PCT No.: PCT/IB2017/052852
§ 371 (c)(1),
(2) Date: Dec. 3, 2018

(87) PCT Pub. No.: WO2017/208097
PCT Pub. Date: Dec. 7, 2017

(65) Prior Publication Data

US 2019/0221910 A1 Jul. 18, 2019

(30) Foreign Application Priority Data

Jun. 3, 2016 (EP) ..... 16305649

(51) Int. Cl.
*H01P 1/18* (2006.01)
*H01P 5/04* (2006.01)
(Continued)

(52) U.S. Cl.
CPC ..... *H01P 1/184* (2013.01); *H01P 3/08* (2013.01); *H01P 5/04* (2013.01); *H01P 11/003* (2013.01); *H01Q 1/48* (2013.01); *H01Q 1/50* (2013.01)

(58) Field of Classification Search
CPC ..... H01P 1/184; H01P 1/18
(Continued)

(56) References Cited

U.S. PATENT DOCUMENTS 3,440,573 A * 4/1969 Butler ..... H01P 1/183 333/161
6,075,424 A 6/2000 Hampel et al.
(Continued)

FOREIGN PATENT DOCUMENTS

CN 1499670 A 5/2004
CN 1633729 A 6/2005
(Continued)

OTHER PUBLICATIONS

Mar. 25, 2020 Office Action issued in Korean Patent Application No. 10-2019-7000180.
(Continued)

*Primary Examiner* — Benny T Lee
(74) *Attorney, Agent, or Firm* — Squire Patton Boggs (US) LLP

(57) ABSTRACT

Apparatus forming a phase-shifter is described. The apparatus comprises a strip line and a moving dielectric part. The moving dielectric part surrounds the strip line and is adapted to move only along a longitudinal axis of the strip line. Within this apparatus the size of the area of the strip line surrounded by the moving dielectric part is modified when the moving dielectric part moves along the longitudinal axis.

14 Claims, 6 Drawing Sheets

(51) Int. Cl.

| | |
|---|---|
| ***H01P 3/08*** | (2006.01) |
| ***H01P 11/00*** | (2006.01) |
| ***H01Q 1/48*** | (2006.01) |
| ***H01Q 1/50*** | (2006.01) |

(58) Field of Classification Search
USPC ..... 333/161
See application file for complete search history.

(56) References Cited

U.S. PATENT DOCUMENTS

| | | | | |
|---|---|---|---|---|
| 6,333,683 | B1 * | 12/2001 | Hampel | H01P 1/184 333/156 |
| 6,816,668 | B2 | 11/2004 | McDonald et al. | |
| 7,283,015 | B1 | 10/2007 | Rockenbauch | |
| 2004/0080380 | A1 | 4/2004 | Marino | |
| 2014/0232484 | A1 * | 8/2014 | Sakasai et al. | H01P 1/184 333/161 |
| 2016/0064797 | A1 | 3/2016 | Bombelli | |

FOREIGN PATENT DOCUMENTS

| | | | |
|---|---|---|---|
| CN | 101816100 | A | 8/2010 |
| CN | 202839907 | U | 3/2013 |
| CN | 103996894 | A | 8/2014 |
| WO | WO 02/35651 | A1 | 5/2002 |

OTHER PUBLICATIONS

International Search Report and Written Opinion dated Jul. 27, 2017 corresponding to International Patent Application No. PCT/IB2017/052852.

First Office Action dated Jun. 22, 2020 corresponding to Chinese Patent Application No. 201780037481.5.

European Communication Pursuant to Article 94(3) EPC, corresponding to EPC, corresponding to EP Application No. 16 305 649.2, dated Mar. 23, 2021.

* cited by examiner

APPARATUS FORMING A STRIP LINE AND DIELECTRIC PART

FIELD OF INVENTION

The present subject matter relates to a phase shifter and more specifically to an electro-mechanical phase shifter. This phase shifter can be used within mobile radio antennas, but also for any Radio Frequency (RF) device requiring a phase shift.

BACKGROUND

The key technical requirements of Base Station antennas for radio communication applications are high gain, high quality horizontal-plane (H-plane) and vertical-plane (V-plane) patterns. Gain and vertical-plane patterns requirements (i.e. tilt value, control of lobes, capability of null fields) are mainly a function of the antenna length and are controlled via the feeding network of the antenna.

Variable Electrical Tilt (VET) antennas have capability of tilt variation, i.e. of main lobe position variation versus the horizon. The adjustment of this tilt position may be achieved through several techniques applied to the antenna feeding network, using active and/or passive devices. The main component needed to achieve such tilt variation is a phase shifter device.

The present application deals with passive phase shifter devices, particularly the family of phase shifters using dielectric materials. At least two "dielectric materials" have to be considered with such technique: a solid device (the so-called "phase shifter") and air (or vacuum). Displacing the solid dielectric material over a propagation line—so replacing the air dielectric—creates a phase variation.

The antenna phase shifted feeding network type used today may comprise several dielectric parts, called phase shifters, these parts may sliding under a stripline, or over a microstrip line, as described within the published patent application US2004/0080380 and the U.S. Pat. No. 6,816,668.

Considering that with such an implementation, each radiating element of the panel antenna may be unitary phase shifted, improving performance of such antenna and stability considering the radiating elements.

The phase shifter of the state of the art comprises the following drawbacks:

This construction requires that the dielectric phase shifter parts must slide transversally, while the central actuator is mechanically moved within the axis of the antenna. This implies the use in specific mechanical parts that will realize the axial-to-transversal mechanical efforts transmissions. These parts have a non-negligible cost, and moreover are a source of additional friction, increase backlashes, and other mechanical malfunctions created by the plurality of parts and associated tolerances. These drawbacks are particularly unwanted considering high frequency systems, such as LTE.

The standard unitary dielectric phase shifters design may achieve phase shift ranges of about ~60° (i.e. for one dielectric device), resulting in the entire phase shifted feeding network the capability to achieve for the antenna a tilt variation of about 10°. Performing higher phase shift ranges such as 100 or 120° is feasible—permitting to reach a 15° antenna tilt range for example—but at either cost of a wider mechanical dielectric part, or/and, the use of a bigger dielectric value. For high frequency scope, as wavelengths are reduced, increasing dimensions isn't a valid option, and, increasing the dielectric value will impose a higher sensitivity regarding the dielectric part positioning and tolerances.

If the Electrical plane patterns are good in terms of value and stability, it is nevertheless difficult to achieve stable Side Lobes Suppression over −20 dBc versus the antenna main beam.

The proposed electro-mechanical phase shifter reduces the three above mentioned drawbacks and is able to deeply reduce the general radio frequency and mechanical constraints related to present Phase Shifter devices, and particularly regarding high frequency bands such as at least 3.5 GHz.

SUMMARY OF THE INVENTION

Various embodiments of phase-shifters are proposed that can solve the previously described problems. More specifically, some embodiments provide a phase-shifter.

This summary is provided to introduce concepts related to examples of phase-shifter.

In one implementation, an apparatus forming a phase-shifter is described. The apparatus comprises a strip line and a moving dielectric part. The moving dielectric part surrounds the strip line and is adapted to move only along a longitudinal axis of the strip line.

Within this apparatus the size of the area of the strip line surrounded by the moving dielectric part is modified when the moving dielectric part moves along the longitudinal axis.

In one implementation, an antenna is described. The antenna comprises an apparatus forming a phase shifter and the apparatus is placed in a housing of which one of the faces is formed by a chassis of the antenna.

BRIEF DESCRIPTION OF THE DRAWINGS

The detailed description is given with reference to the accompanying drawings. In the drawings, the left-most digit(s) of a reference number identifies the figure in which the reference number first appears. The same numbers are used throughout the figures to reference like features and components. Some embodiments of system and/or methods in accordance with embodiments of the present subject matter are now described, by way of example only, and with reference to the accompanying figures, in which.

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

DETAIL DESCRIPTION OF THE EMBODIMENTS

Figure 1:
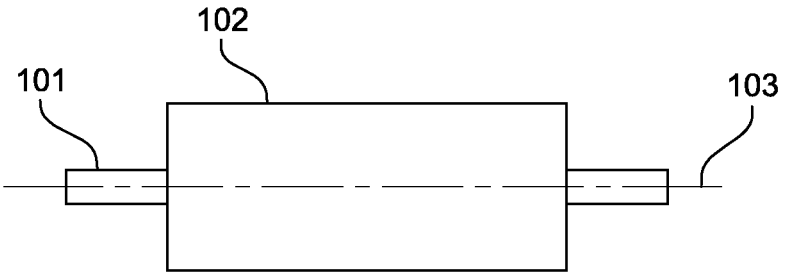
FIG. 1 presents a phase-shifter.

FIG. 1 presents an embodiment of the apparatus of the present subject matter. The apparatus forms a phase-shifter.

The apparatus comprises a strip line 101 and a moving dielectric part 102. The moving dielectric part 102 surrounds the strip line 101 and is adapted to move only along a longitudinal axis 103 of the strip line. The strip line is also known as propagation line. Wherein the size of the area of the strip line 101 surrounded by the moving dielectric part 102 is modified when the moving dielectric part 102 moves along the longitudinal axis 103.

In order to have the size of the area of the strip line 101, surrounded by the moving dielectric part 102, modified, when the moving dielectric part 102 moves along a longitudinal axis 103, the strip line 101 can have an L (see enlarged view of the FIG. 2) shape or a triangular shape 204.

This embodiment allows a "perfect" mechanical position of phase shifter versus the propagation line. So using this embodiment allows the phase-shifter to work at high frequency bands such as at least 3.5 GHz.

In an embodiment the apparatus also comprises a guide or guiding means. These guiding means are configured to guide the movement of the moving dielectric part 102 along the longitudinal axis 103 of the strip line 101.

Figure 2:
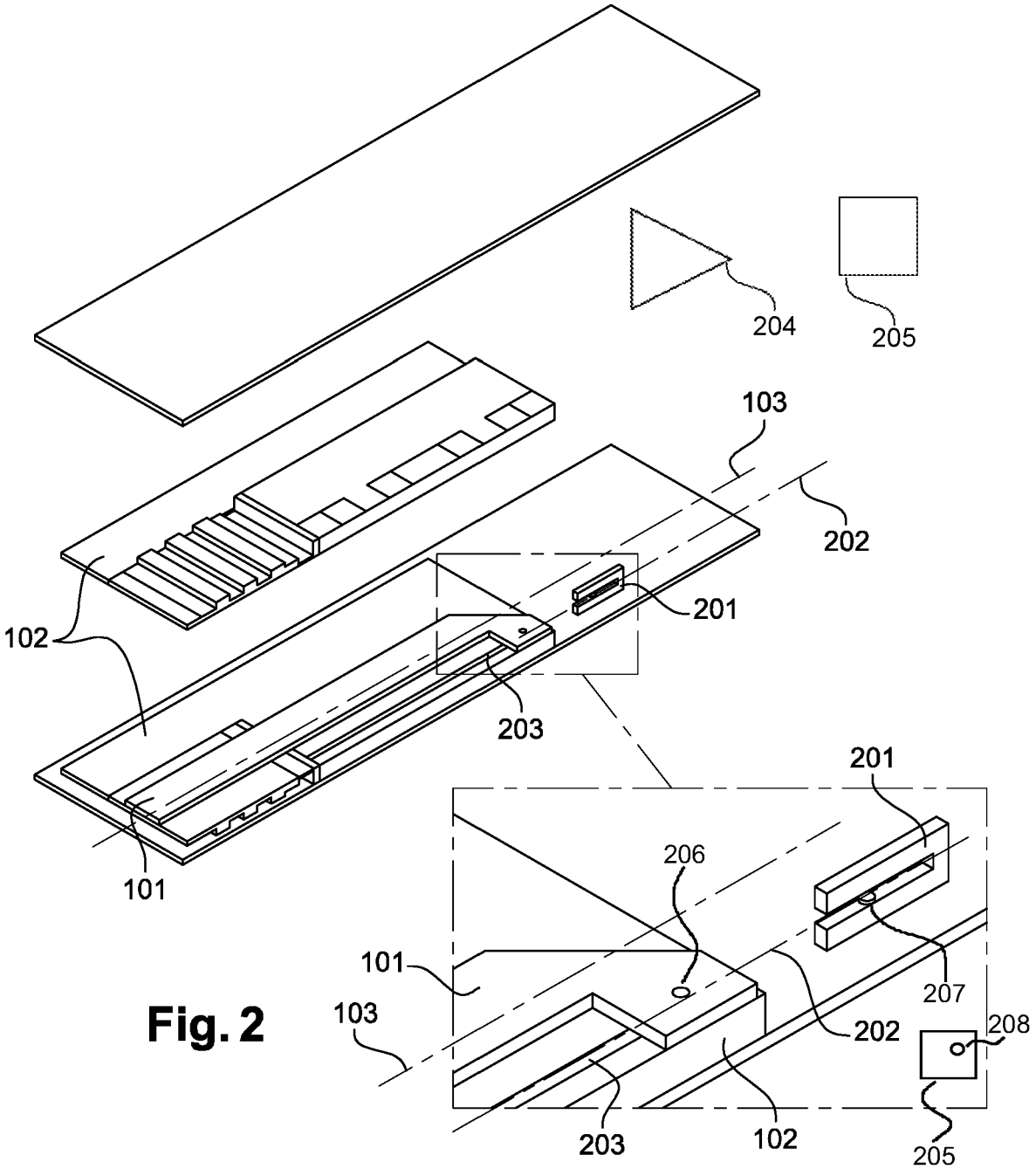
FIG. 2 presents a phase-shifter.

FIG. 2 presents another embodiment of the phase shifter. In this embodiment the guiding means are constituted of a key 201 placed along a parallel axis 202 to the longitudinal axis 103 of the strip line 101 and a keyway 203 realize within the moving dielectric part 102. The key 201 is configured to be fixed with respect to the strip line 103 and to cooperate with the keyway 203. The key 201 is also configured to allow the movement of the moving dielectric part 102 only along the longitudinal axis 103 of the strip line 101. The keyway is also known as a slot.

In an embodiment, the key 201 is fixed to the strip line 101 at 206 and 207, or the key 201 and the strip line 101 may be both fixed to a ground plate 205 at 206-208.

In an embodiment, the key 201 is a clip made for example of plastic dielectric.

In an embodiment where the key is inserted, the key may have a length at least equal to the width of the strip line, and made from the same dielectric material as the phase shifter device. This avoids any modification of the strip line area where the key is inserted. In this embodiment a slot (or keyway) is placed all along the phase shifter at the corresponding position of the clip, in order to be able to slide the phase shifter along the longitudinal axis. Within this embodiment, there is no modification of the general radio frequency construction and so the phase shifter behavior may not be modified compared to phase-shifter of the state of the art.

Figure 3A:
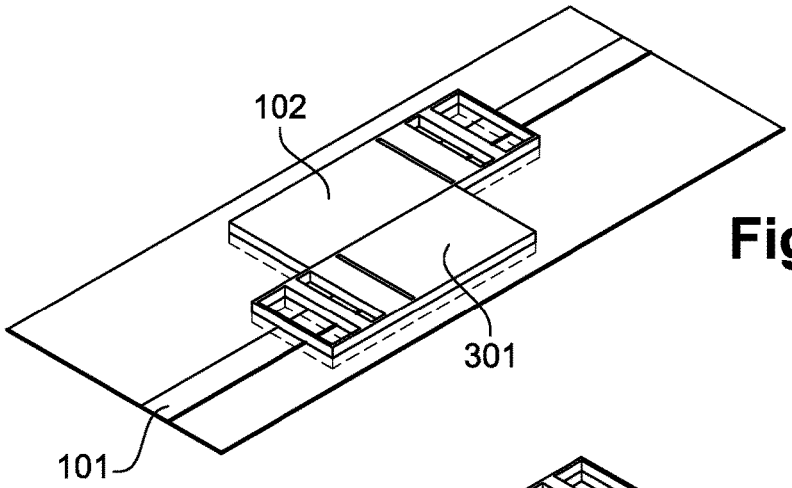
FIGS. 3-*a*, 3-*b*, and 3-*c* present a phase-shifter.
Figure 3B:
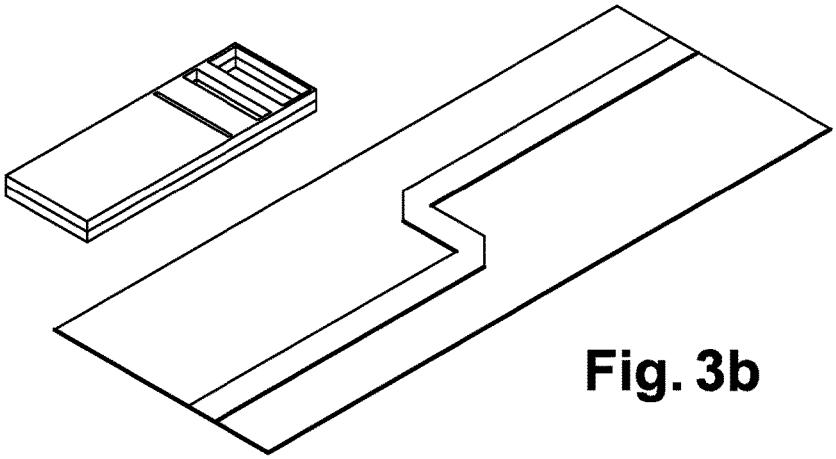
Figure 3C:
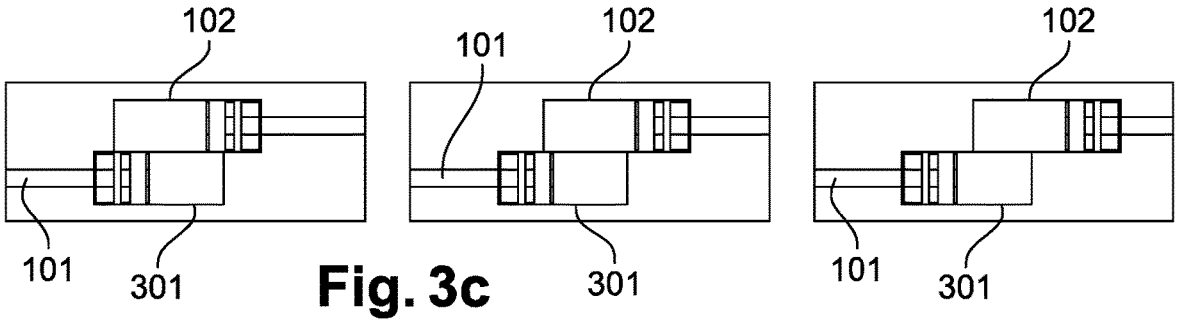

FIG. 3-*a* presents another embodiment of the phase-shifter. In this embodiment the guiding means are constituted of a second dielectric part 301 configured to be static with respect to the strip line and arranged to allow the movement of the moving dielectric part 102 only along a longitudinal axis 103 in FIGS. 1 and 2 of the strip line 101.

FIG. 3-*b* present the size of the different elements of the phase shifter according to one embodiment. This phase-shifter is capable of convenient radio frequency performances from 3.4 GHz up to 4.2 GHz. This phase shifter is realized using a suspended stripline mode. A PCB—here a single side ROGERS RT DUROID 5870 (high frequency laminate) of 0.254 mm thick, 0.35 microns of copper—is placed at the center of two metallic ground planes (not represented here) i.e. one at the top and one at the bottom, spaced here of 7.2 mm. On each sides of this PCB are placed one fix dielectric Phase Shifter, which may be positioned at the top and bottom, and one top moveable dielectric Phase Shifter and one bottom moveable dielectric Phase Shifter—made here of a dielectric material of a dielectric constant of 4.

FIG. 3-*c* depicted top views of the FIG. 3-*a* Phase Shifter topology sliding 30 mm in an axial movement (min, avg, max), including second dielectric part 301, moving dielectric part 102, and strip line 101. One of the Phase shifters is kept fixed and the second one is translating.

Figure 4:
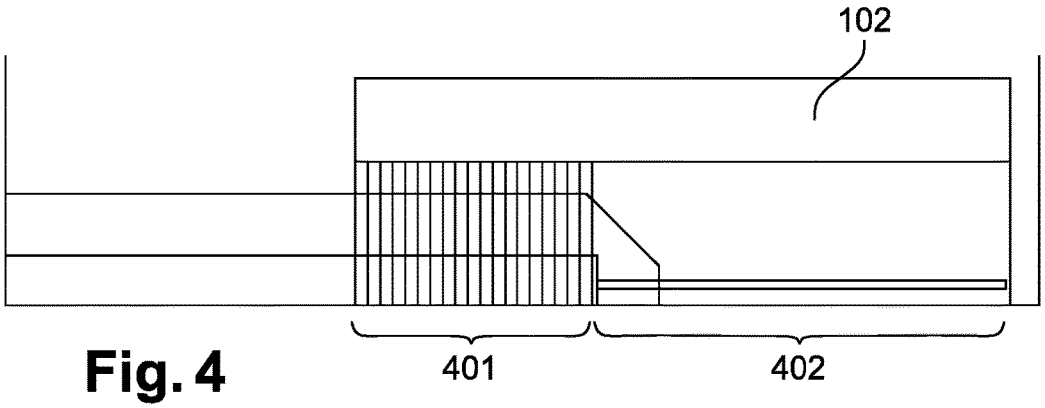
FIG. 4 presents a phase-shifter.
Figure 5A:
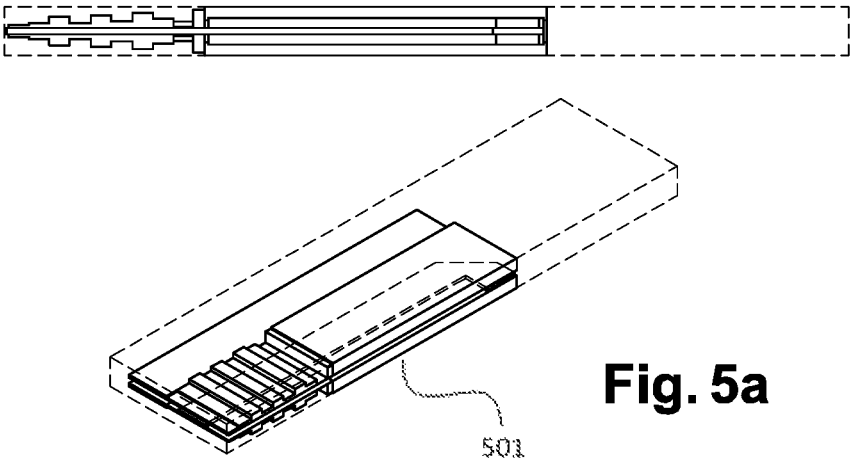
FIGS. 5-*a*, 5-*b*, 5-*c*, 5-*d*, 5-*e*, and 5-*f* present examples of other phase shifters impedance transformer designs.
Figure 5B:
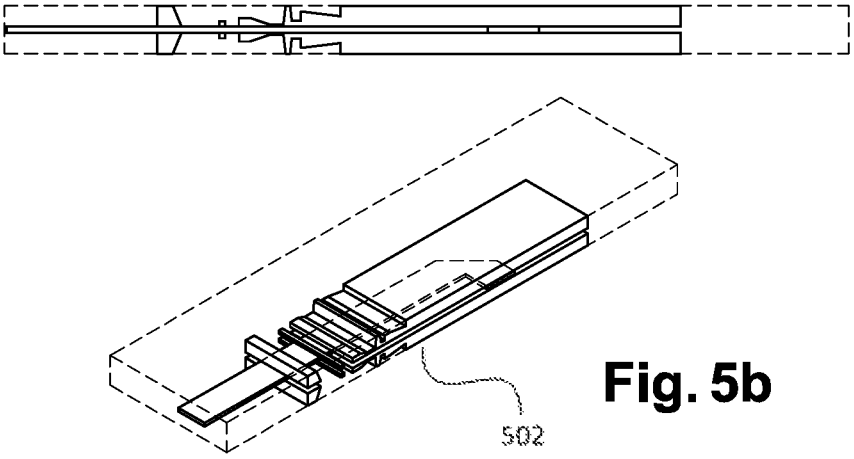
Figure 5C:
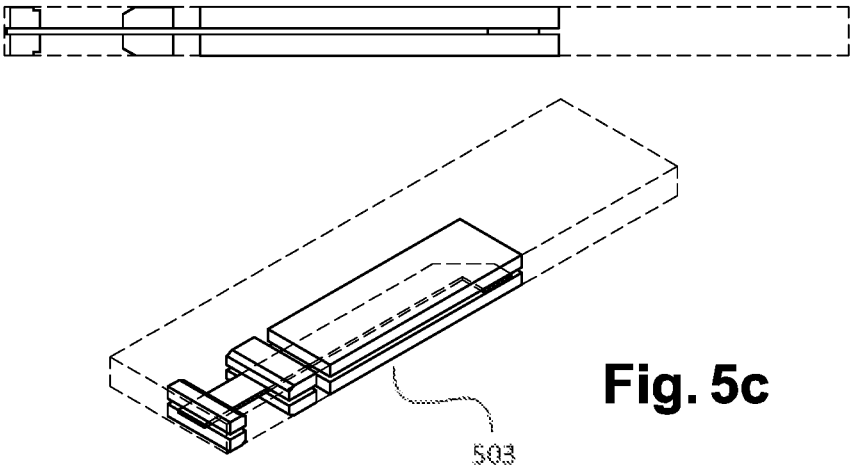
Figure 5D:
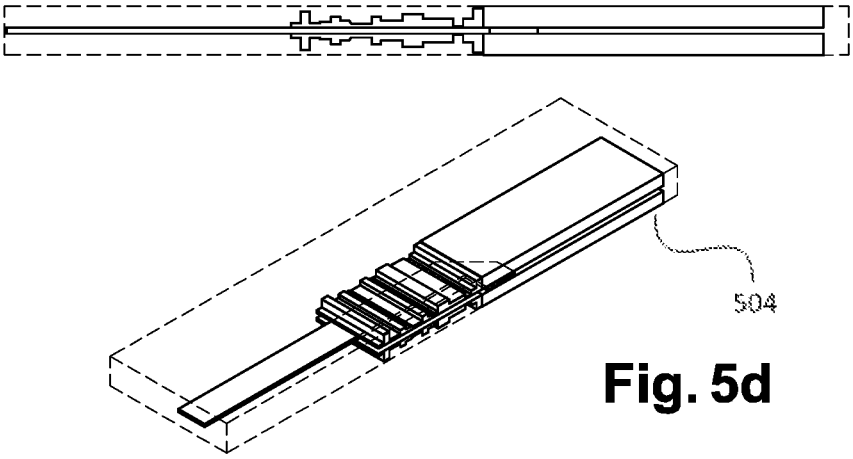
Figure 5E:
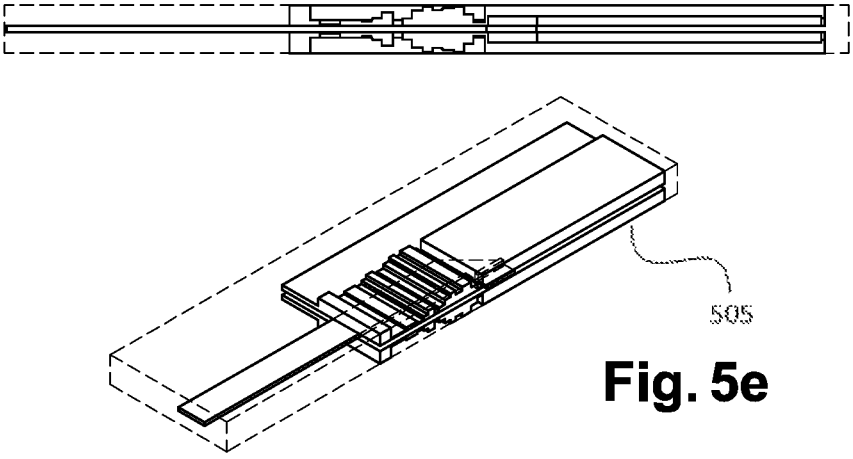
Figure 5F:
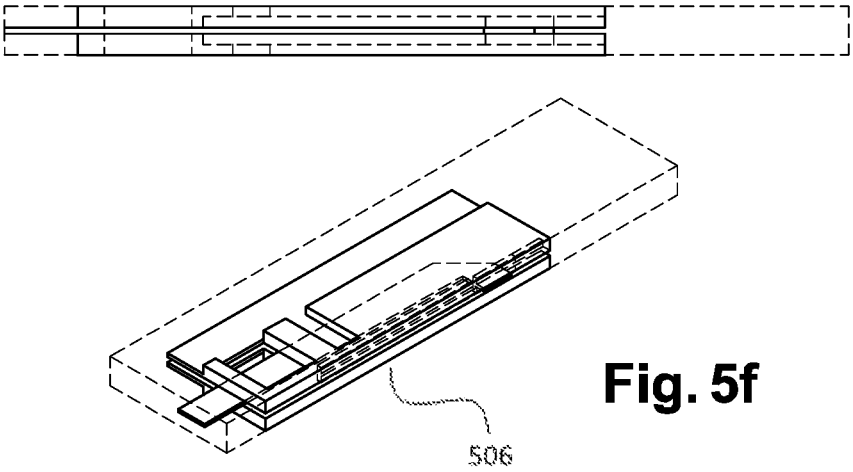

FIG. 4 presents an embodiment of the phase shifter in which the moving dielectric part 102 also comprises an impedance transformation part 401 and a fixed impedance part 402. In other words, within this embodiment, the moving dielectric part is made of three main areas. The first area is the impedance transformation part. The second area is relative to a fixed impedance area. Considering that the transmission line is continuously displacing below the third area, a modification made on the third area at a certain position will not have or have low influence at another position. So, some variations may be created on the dielectric part, as thicknesses variations, all along the third area in order to create some "fine tunings" of the input and output impedances.

FIGS. 5-*a* to 5-*f* present respectively examples of other phase shifters impedance transformer designs 501-506 of a phase shifter impedance transformer that will permit to achieve the same kind of performances. The phase shifter of the present subject matter can be used with different impedance transformer section.

In an embodiment the moving dielectric part 102 in FIGS. 1 and 2 are constituted of two identical parts the first part placed over the strip line and the second part placed under the strip line.

In another embodiment the strip line 101 in FIGS. 1 and 2 is made by etching a metal layer of a printed circuit board.

An embodiment of the present subject matter is an antenna that comprises the apparatus of any of the preceding embodiments. The phase-shifter is placed in a housing of which one of the faces is formed by a chassis of the antenna.

In other words the different embodiments of the phase shifter may guarantee the "perfect" mechanical position of the moving dielectric part versus the propagation line. Indeed the extra parts (for example the key and keyway) inserted in the different elements of the phase-shifter, and are cause of increasing the mechanical tolerances between the dielectric phase shifters and the propagation line.

In an embodiment and ensure that the phase shifter mechanical positioning is directly referenced to the propagation line, a small part, called "guide" or key may be inserted directly onto the line.

Figure 6A:
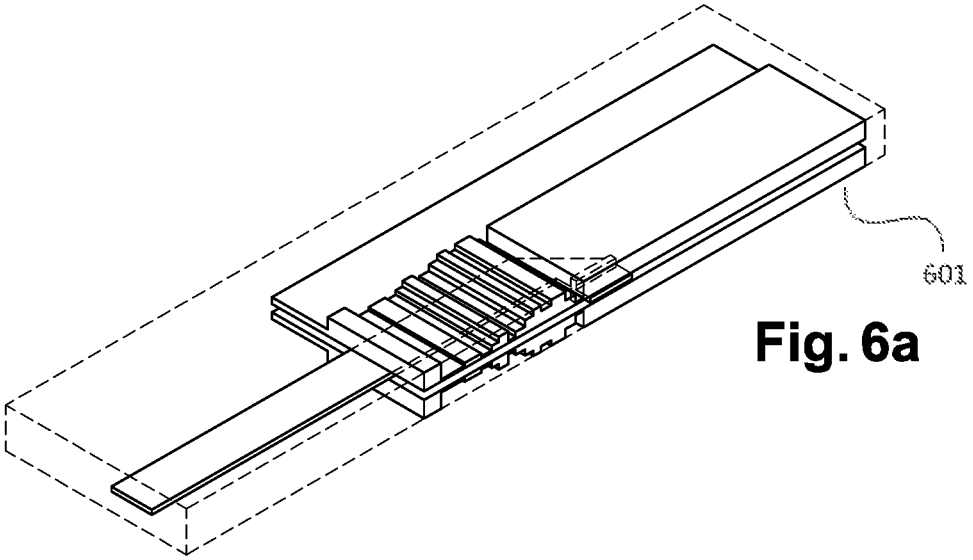
FIGS. 6-*a*, 6-*b*, and 6-*c* presents a phase-shifter at different positions.
Figure 6B:
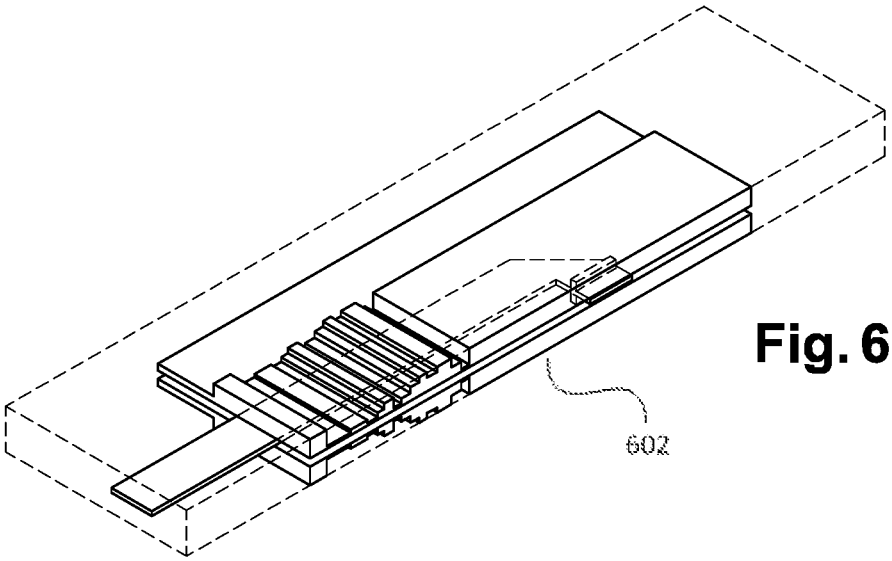
Figure 6C:
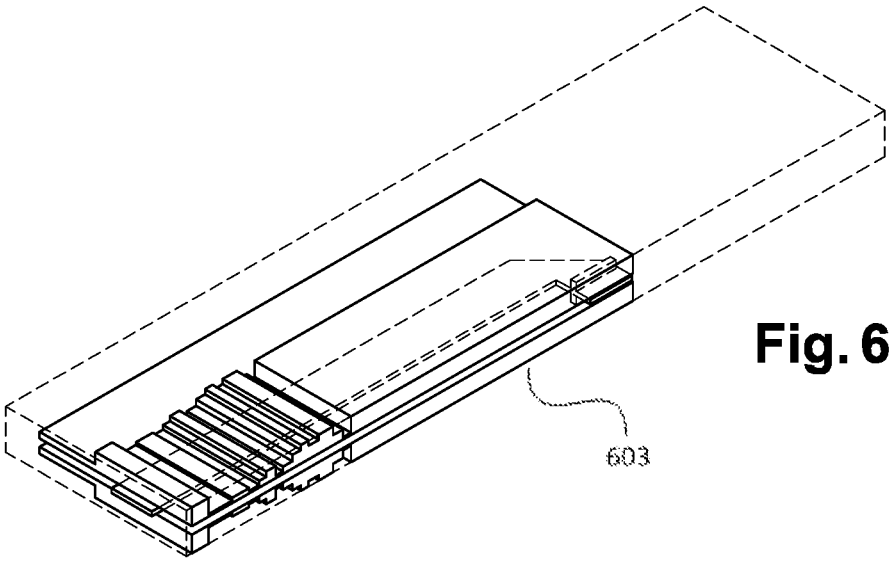

FIG. 6-*a*, 6-*b* and 6-*c* presents respectively the phase shifter at min 601, mid 602 and max 603 mechanical positions of a phase shifter impedance transformer.

Figure 7A:
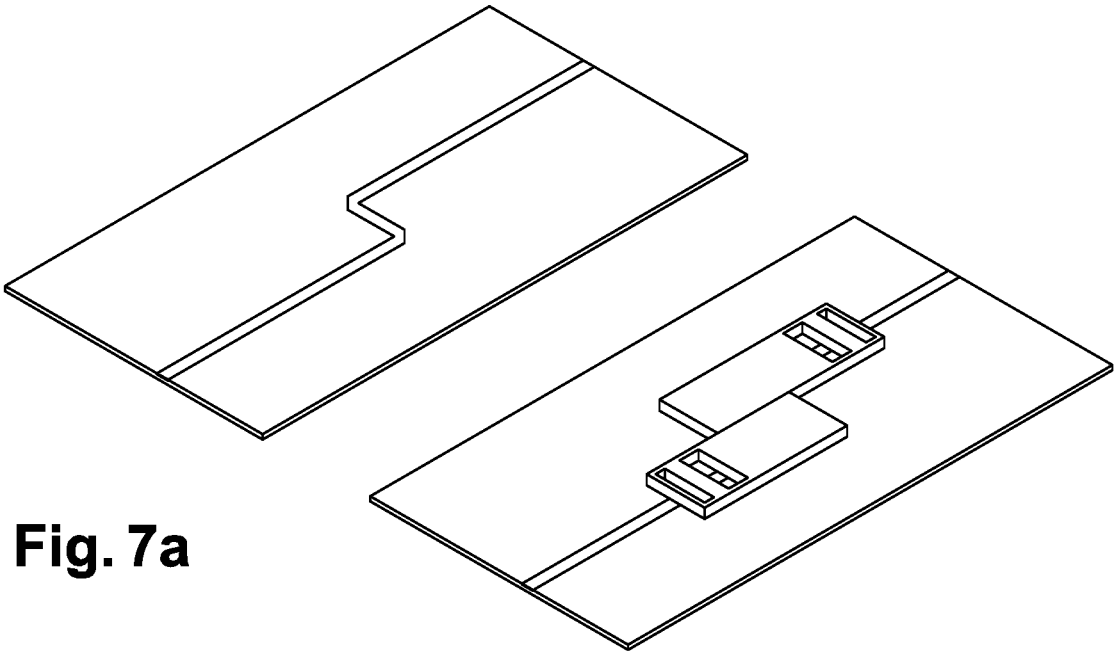
FIGS. 7-*a* and 7-*b* present another embodiment of the phase shifter.
Figure 7B:
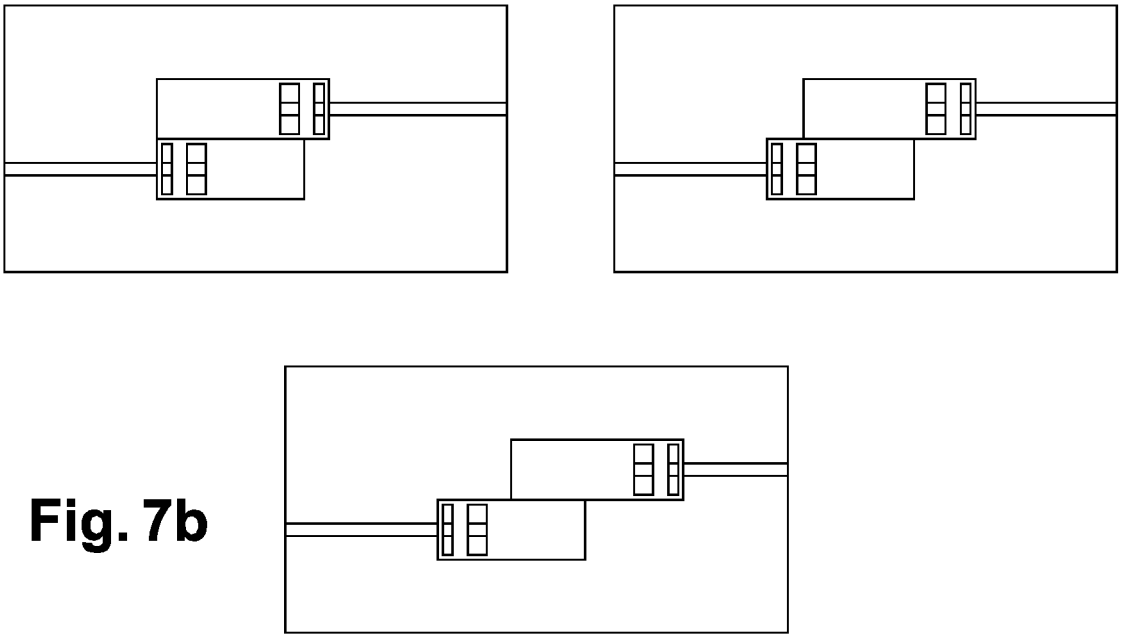

FIGS. 7-*a* and 7-*b* present another embodiment of the phase shifter impedance transformer. This phase shifter is made with a microstrip. All the phase shifters of the previous embodiments can work with microstrip instead of stripline or suspended stripline. Within this embodiment a Taconic TLX PCB (0.787 mm thick) is used to realize a 50 Ohms microstrip line (copper trace width is about 2.25 mm for 35 microns thick). Over this PCB is placed two 2 mm thick dielectric elements, made of a material with a dielectric constant of about 10.

One other object of the present subject matter is an antenna comprising one of the phase-shifter previously described. This phase-shifter is placed in a housing of which one of the faces is formed by a chassis of the antenna.

The invention claimed is:

1. An apparatus, comprising:

a strip line; and a moving dielectric part, the moving dielectric part surrounding the strip line and being adapted to move only along a longitudinal axis of the strip line, wherein the apparatus is configured to perform phase shifting, wherein a size of an area of the strip line surrounded by the moving dielectric part changes as the moving dielectric part moves along the longitudinal axis, wherein the moving dielectric part further comprises an impedance transformation part and a fixed impedance part, and wherein a guide configured to guide a movement of the moving dielectric part along the longitudinal axis of the strip line; and the guide comprises a further dielectric part configured to remain static with respect to the strip line and configured to allow movement of the moving dielectric part only along the longitudinal axis of the strip line.

2. An antenna comprising the apparatus of claim 1, wherein the apparatus is disposed in a housing having a face comprising a chassis of the antenna.

3. The apparatus according to the claim 1, wherein:

the guide comprises a key disposed along an axis parallel to the longitudinal axis of the strip line and a keyway located within the moving dielectric part, and the key is configured to be fixed with respect to the strip line and to cooperate with the keyway and to allow the movement of the moving dielectric part only along the longitudinal axis of the strip line.

4. The apparatus according to the claim 3, wherein:

the key is fixed to the strip line, or the key and the strip line are both fixed to a ground plate.

5. The apparatus according to the claim 3, wherein:

the key is a clip comprising a plastic dielectric.

6. The apparatus according to claim 1, wherein the strip line has an L shape or a triangular shape.

7. The apparatus according to claim 1, wherein:

the strip line is made by etching a metal layer of a printed circuit board.

8. The apparatus according to claim 1, wherein:

the moving dielectric part comprises two identical parts; a first part placed over the strip line, and a second part placed under the strip line.

9. An apparatus, comprising:

a strip line; and a moving dielectric part, the moving dielectric part surrounding the strip line and being adapted to move only along a longitudinal axis of the strip line, wherein the apparatus is configured to perform phase shifting, wherein a size of an area of the strip line surrounded by the moving dielectric part changes as the moving dielectric part moves along the longitudinal axis, wherein the moving dielectric part further comprises an impedance transformation part and a fixed impedance part, and wherein a guide comprises a key disposed along an axis parallel to the longitudinal axis of the strip line and a keyway located within the moving dielectric part, the key is configured to be fixed with respect to the strip line and to cooperate with the keyway and to allow the movement of the moving dielectric part only along the longitudinal axis of the strip line, and the key is a clip comprising a plastic dielectric.

10. A method of forming a phase shifter, said method comprising:

providing a strip line, said strip line having a longitudinal axis;

providing a moving dielectric part, said moving dielectric part being movable relative to the strip line along the longitudinal axis, said moving dielectric part being formed to surround the strip line, wherein a size of an area of the strip line that is surrounded by the moving dielectric part changes when the moving dielectric part moves along the longitudinal axis, and wherein the moving dielectric part further comprises an impedance transformation part and a fixed impedance part; and providing a guide, said guide being configured to guide a movement of the moving dielectric part along the longitudinal axis of the strip line, wherein the guide is formed of a further dielectric part and configured to remain static with respect to the strip line, and configured to allow movement of the moving dielectric part only along the longitudinal axis of the strip line.

11. The method according to claim 10, wherein the guide is provided in the form of a key disposed along an axis parallel to the longitudinal axis of the strip line, and a keyway located within the moving dielectric part, wherein the key is configured to be fixed with respect to the strip line and to cooperate with the keyway and to allow movement of the moving dielectric part only along the longitudinal axis of the strip line.

12. The method according to claim 11, wherein the key comprises a clip formed of a plastic dielectric.

13. The method according to claim 10, wherein the moving dielectric part is formed of two identical parts, wherein a first part is placed over the strip line and a second part is placed under the strip line.

14. The method according to claim 10, wherein the strip line is formed by etching a metal layer of a printed circuit board.

* * * * *